US005836696A

United States Patent [19]

Schnell

[11] Patent Number: 5,836,696

[45] Date of Patent: Nov. 17, 1998

[54] SACK HAVING OUTWARDLY EXPANDABLE WALLS

[75] Inventor: Mark L. Schnell, Kiel, Wis.

[73] Assignee: H.G. Weber and Companu, Inc., Kiel, Wis.

[21] Appl. No.: 943,865

[22] Filed: Oct. 8, 1997

Related U.S. Application Data

[63] Continuation-in-part of Ser. No. 653,503, May 2, 1996, abandoned.

[51] Int. Cl.[6] ..... B65D 30/20

[52] U.S. Cl. ..... 383/120; 383/125

[58] Field of Search ..... 383/120, 2, 124, 383/125, 112; 229/67.3, 87.03, 928

[56] References Cited

U.S. PATENT DOCUMENTS

| | | | |
|---|---|---|---|
| 1,767,274 | 6/1930 | Broderick | 383/120 X |
| 2,386,062 | 10/1945 | Roehrl | 383/120 X |
| 2,628,764 | 2/1953 | Rubinstein et al. | 383/120 |
| 2,704,183 | 3/1955 | Stern | 383/120 |
| 4,096,987 | 6/1978 | Rodish | 383/120 X |
| 4,526,565 | 7/1985 | Hummel et al. | 383/120 X |
| 4,930,903 | 6/1990 | Mahoney | 383/26 X |

FOREIGN PATENT DOCUMENTS

| | | | |
|---|---|---|---|
| 61243 | 6/1948 | Netherlands | 229/87.03 |
| 345529 | 5/1950 | Switzerland | 383/125 |
| 614223 | 12/1948 | United Kingdom | 229/87.03 |
| 621273 | 4/1949 | United Kingdom | 229/87.03 |

*Primary Examiner*—Jes F. Pascua
*Attorney, Agent, or Firm*—Hill & Simpson

[57] ABSTRACT

An expansible folded SOS type sack having a preselected rectangular bottom size and side walls having multiple folded portions including a longitudinal fold down the longitudinal center line and gussets along opposite edges. The gusseted side walls allow the bag to open to a depth greater than that defined by the bottom of the sack for carrying oversized objects.

8 Claims, 4 Drawing Sheets

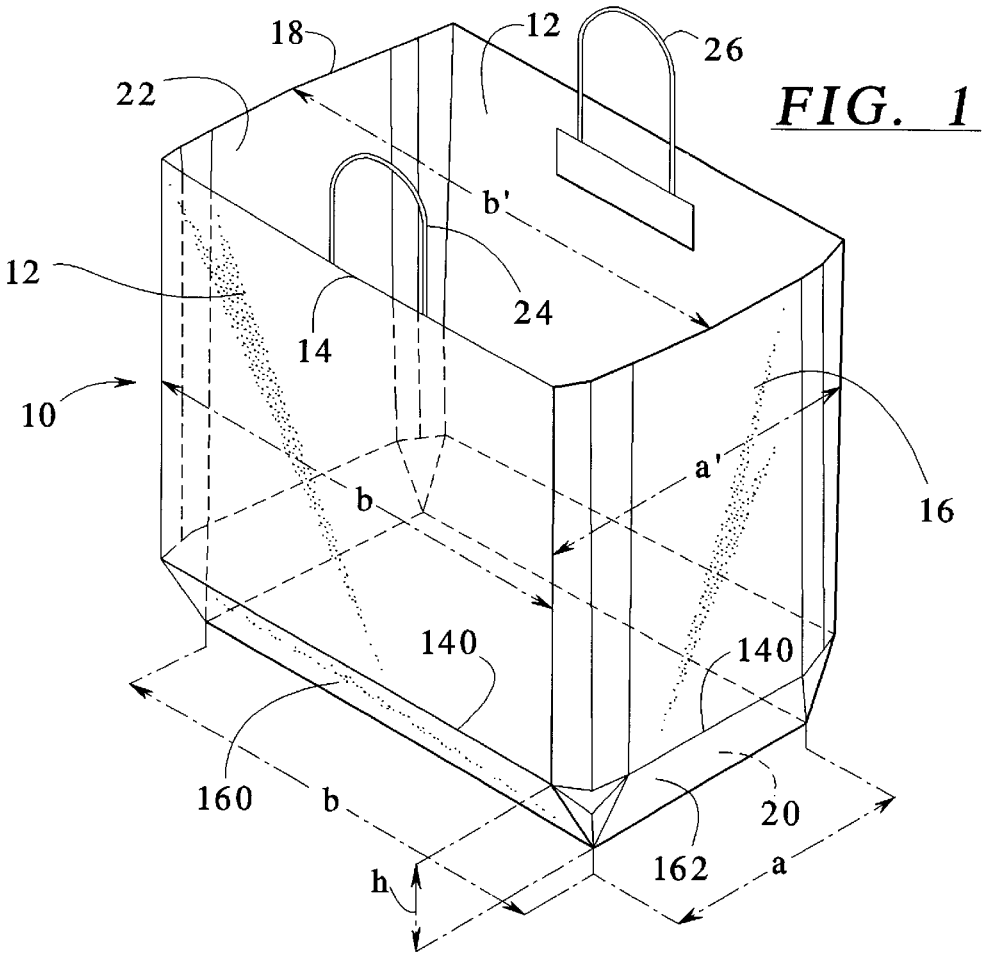
FIG. 1
FIG. 2
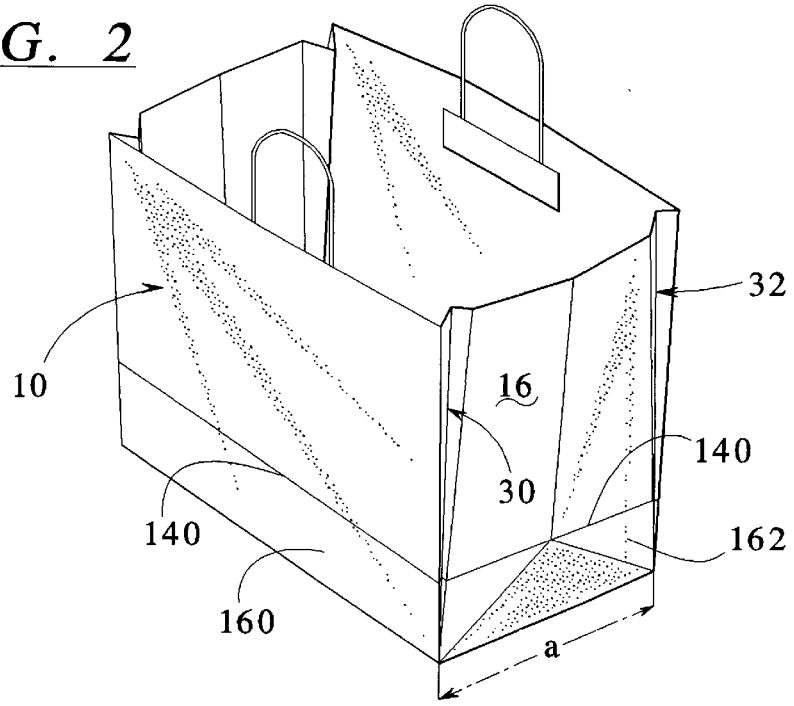

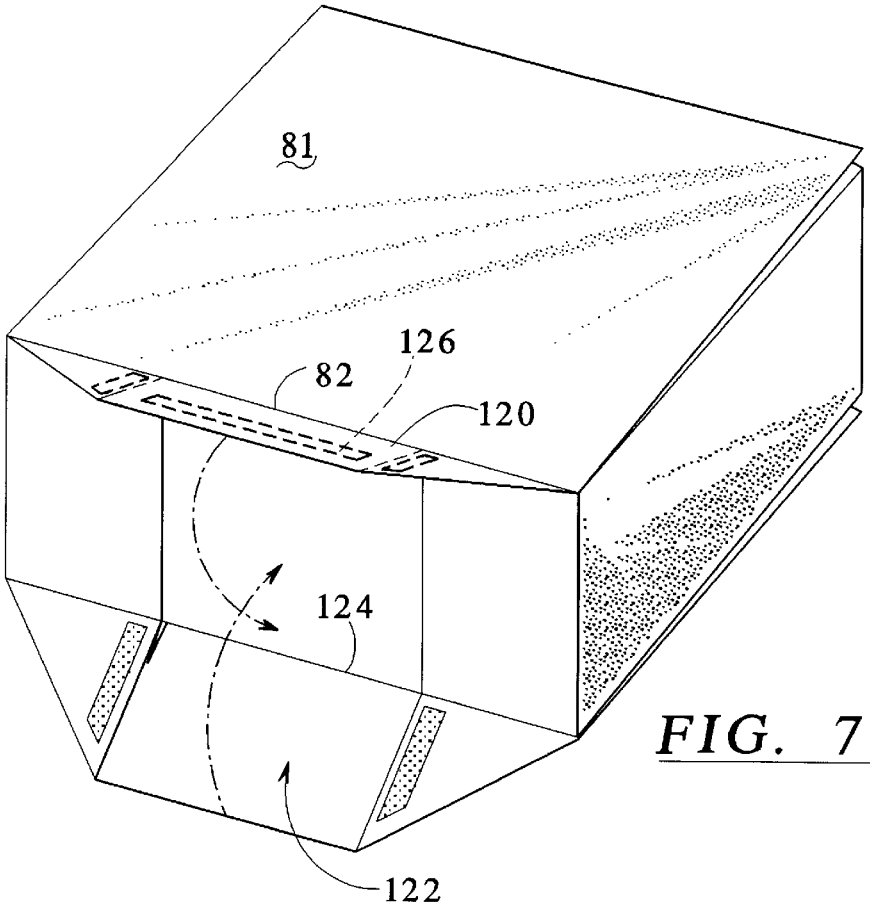
FIG. 7
FIG. 8
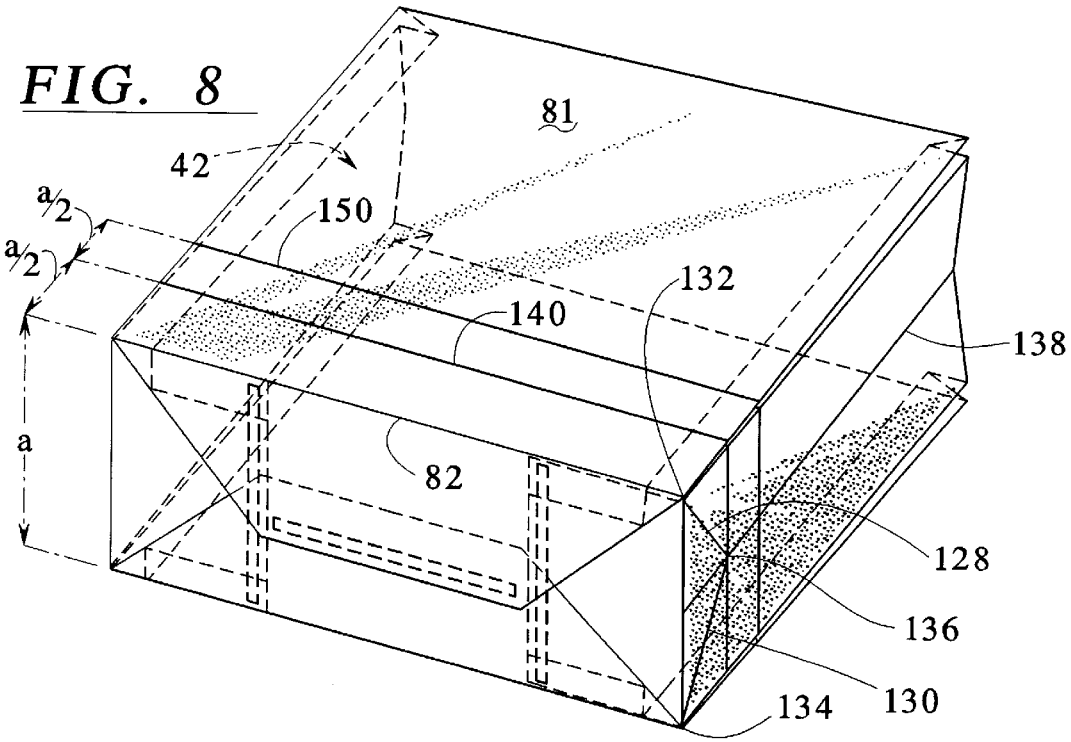

SACK HAVING OUTWARDLY EXPANDABLE WALLS

This application is a continuation-in-part application of parent U.S. application Ser. No. 08/653,503 filed on May 24, 1996,now abandoned.

BACKGROUND OF THE INVENTION

The present invention relates to stand open satchel ("SOS") bags or sacks and a method of producing the sacks. The SOS type bags are typically produced by starting with a square or rectangular tube, scoring the side and top and bottom walls and forming a bottom by folding portions of the side and bottom walls inwardly and securing by gluing. Each longitudinal side of the sack has a gusset fold so that the sack can be folded flat, for storing. Typical SOS sacks are limited in their opening capacity by the area of the folded rectangular bottom.

Machinery for folded bottom bags has a size limitation for a particular folded bottom. It would be desirable to provide a SOS sack which provides additional volume and of the aforementioned type and is capable of being formed on existing machinery.

SUMMARY OF THE INVENTION

It is an object of the present invention to provide a SOS bag which has a rectangular formed and glued bottom but which is expandable above the bottom to hold oversized articles such as restaurant carry out trays.

It is an object of the invention to provide an expandable SOS bag which can be manufactured on existing machinery having a folded bottom size limit but which will produce a larger functional bottom size for that particular machinery.

The objects of the invention are achieved by providing a SOS bag construction, formed from a rectangular tube having on each side a longitudinal fold running on the longitudinal center line of each side, and two gussets one running along each edge of each side. A conventional rectangular folded bottom is formed having a width equal to the top and bottom sides of the rectangular tube and a depth equivalent to a distance between the gussets. At a short distance above the folded bottom, the sides of the bag can expand outwardly, unfolding the gussets to form an expandable bottom region slightly elevated from the folded rectangular bottom.

From the short distance above the folded bottom to the top of the bag, the generally rectangular tube expands outward in such a manner that each pair of opposed parallel walls of the rectangular tube expand outward relatively to one another and yet remain generally parallel to one another.

By using this multi-gusseted construction, a typical 6 inch depth bottom can be expanded to 10 inch depth functional bottom region. This bag can be formed in the same machinery that would be used to form single gusseted side bags limited to its 6 inch deep bottom.

According to the method of forming the bag, the bag can be constructed using the same machinery which forms a typical SOS folded bottom bag. The bag can be made on a multi-plate former. Spot or line glue is positioned between the minor gussets in lower areas of flap length when in the tube formation process. No special bottom folding parts are anticipated to be needed.

Although each side wall of the bag is described as having two gussets, one along each edge of the side walls, any number of gussets can be employed on the side walls, positioned on the edge as shown or possibly inward of the edge such as more centrally located on the side wall.

BRIEF DESCRIPTION OF THE DRAWINGS

FIG. 1 is a perspective view showing the sack of the present invention in a fully expanded condition;

FIG. 2 is a perspective view showing the sack of FIG. 1, in an unexpanded condition;

FIG. 7 is a perspective view of the tube of FIG. 6 in a further stage of bottom folding; and FIG. 8 is a perspective view of the tube with a completed bottom.

DETAILED DESCRIPTION OF THE PREFERRED EMBODIMENTS

Figure 3:
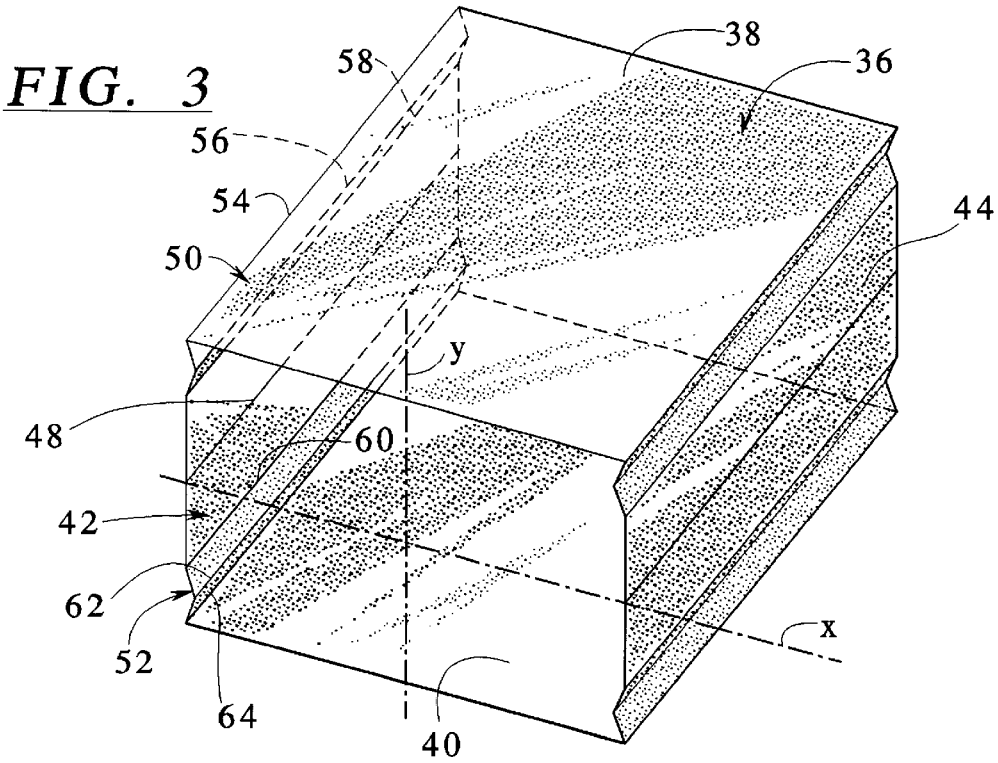
FIG. 3 is a perspective view of a tube which is manufactured into the sack of the present invention.

FIG. 1 illustrates a sack 10 of the present invention in a fully expanded condition. The sack includes a front wall 12, a back wall 14, a first multi-gusset side wall 16, and a second multi-gusset side wall 18. The sack includes a rectangular folded and glued bottom 20 and an open top 22. Handles 24, 26 can be provided for using the bag in a vertically oriented hanging position, such as a shopping bag. The bottom 20 has a depth dimension a and a width dimension b. The side wall 12 also has the width dimension b but in a expanded condition under force from articles held within the bag, above a height h, the bag has a depth dimension a'. Also, depending on the force from the articles inside the bag, the bag can have an increased width dimension b'. By using the pleated side wall 16, 18, the bag can typically be expanded from, for example, a 6 inch dimension a at the bottom, to a 10 inch dimension a' above a height h.

FIG. 2 shows the bag 10 having V-shaped cross section gussets 30, 32 on the first side wall 16 in a loose, non-expanded condition wherein the gussets can be folded flat so that the overall depth dimension of the bag approximates a.

FIG. 3 illustrates a preliminary step of forming the bag wherein a tube 36 is fed to a folding and gluing machine. The tube is pre-formed having front wall 38, rear wall 40, first side wall 42, and second side wall 44. The first side wall 42 includes a longitudinal fold 48 and gussets 50, 52. The gusset 50 includes edge fold 54, median fold 56, and mating fold 58. The second gusset includes mating fold 60, median fold 62 and edge fold 64. The tubular bag, its folds, and its formation are mirror image identical about the axis x and the axis y and as such, only one corner needs to be described.

Figure 4:
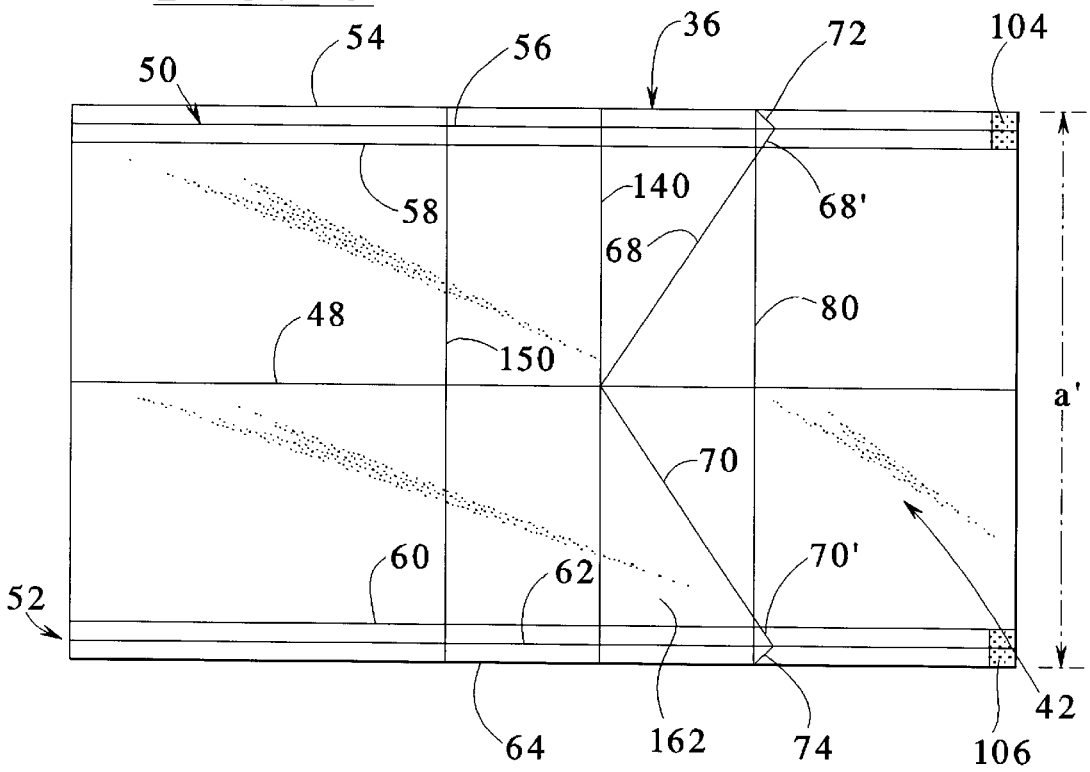
FIG. 4 is a left side view of the tube shown in FIG. 3.

FIG. 4 shows a side view of the tube 36 with the gussets 50, 52 fully flared outwardly. Triangular folds 68, 70, 68', 70' which extend into the longitudinal fold 48 to the median folds 56, 62 provide strategic folding as will be described below. The partial fold lines 68', 70' terminate at the median folds 56, 62 and oblique folds 72, 74 extend in an opposite direction to the edge folds 54, 64. A bottom fold 80 extends completely across the bag side wall 42.

Figure 5:
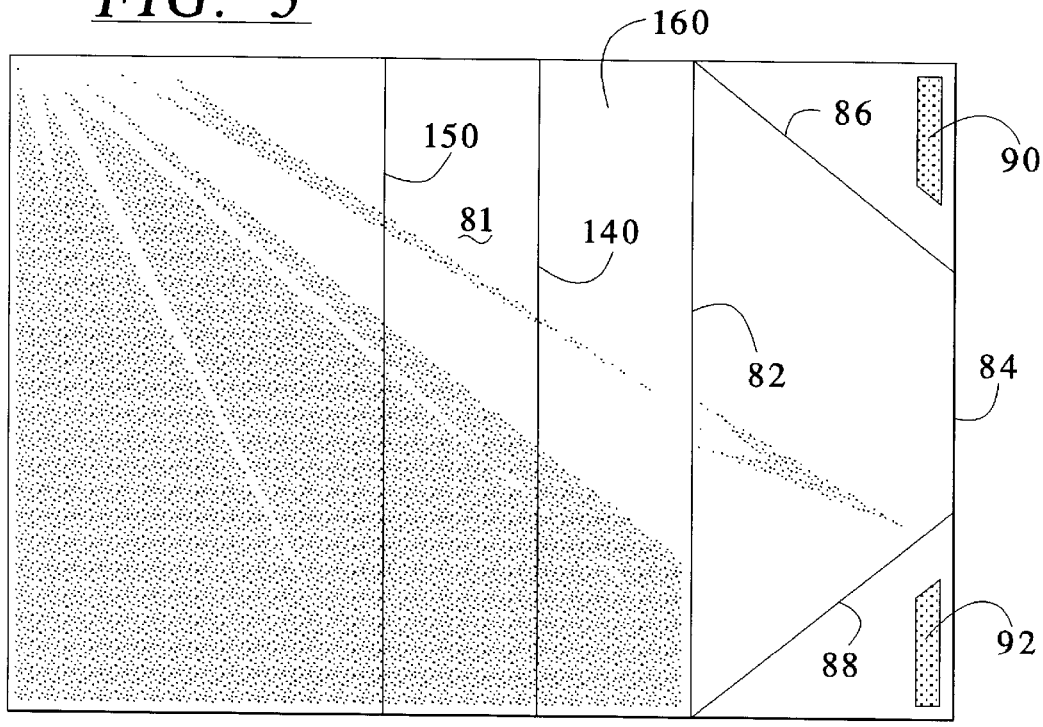
FIG. 5 shows a top view of the tube shown in FIG. 3.

FIG. 5 illustrates the front wall 81 with a coplanar bottom fold 82, coplanar with the bottom fold 80 shown in FIG. 4. Extending from the bottom fold 82 toward an end 84 of the tube are a first oblique fold 86 and a second oblique fold 88. The folds 86, 88 are at 45° to the end 84 of the tube.

Adhesive areas 90, 92 are provided on an outside of the oblique fold 86, 88.

Figure 6:
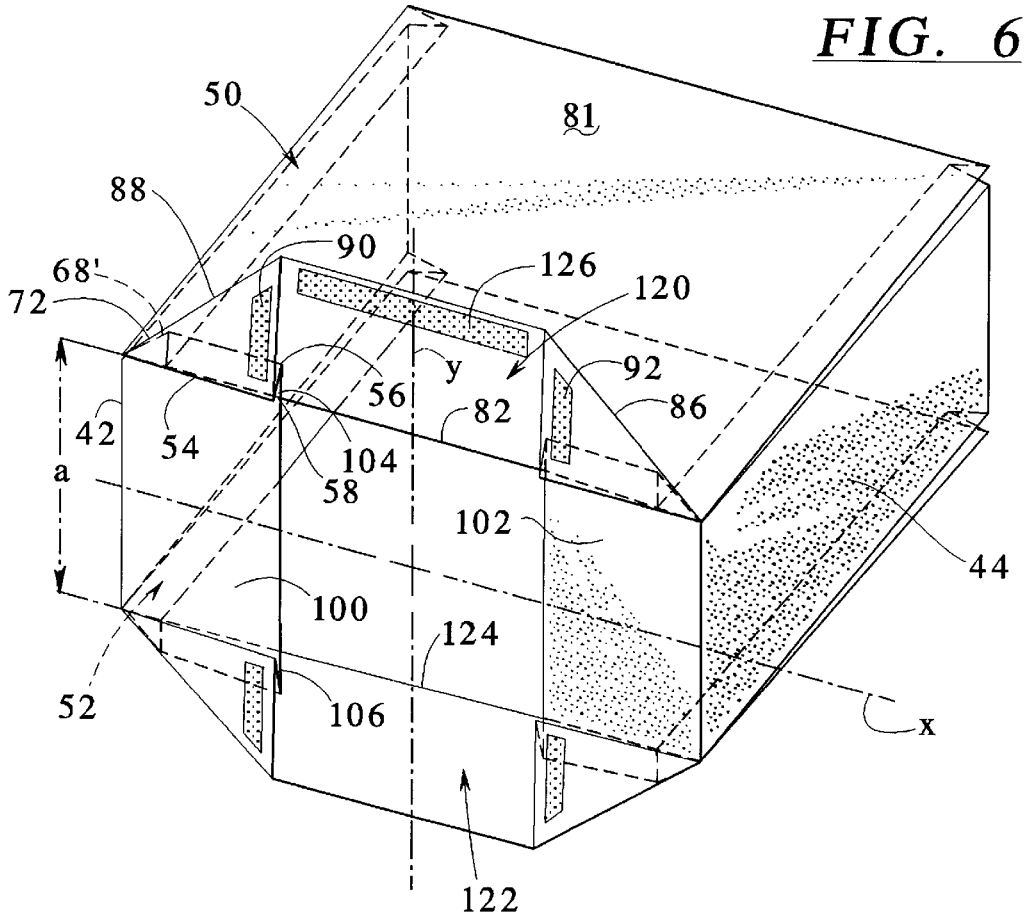
FIG. 6 is a perspective bottom view of the tube of FIG. 3 with a bottom partially formed.

As shown in FIG. 6, bottom rectangular portions 100, 102 are folded inwardly from the side walls 42, 44 having the depth a. The gusset 50 is folded flat on its median fold 56. The oblique fold 72 is folded onto the triangular fold 68' as the front wall is folded along its oblique fold 88. The folds 72, 68' and 88 align and fold over together. The gussets 50, 52 in the bottom region thereof are held tightly closed and adhesively secured by adhesive areas 104, 106.

As shown in FIG. 7, a thus formed trapezoidally shaped front flap 120 can now be folded down along the line 82 along the entire width of the bottom downwardly and a similar, mirror image rear wall trapezoidal flap 122 can be folded along a line 124 upwardly wherein the flap 120 overlies the flap 122 and is secured therein by an area of adhesive 126.

Thus, the bottom folded bag is complete as shown in FIG. 8. For ease of manufacture, it is noted that the gussets may need to be no less than 2 inches open size. Additionally, shown in FIG. 8 are side triangular folds 128, 130 which extend from corners 132, 134 toward the opposite open end and meet at an apex 136 on a longitudinal fold 138. A circumferential fold 140 also meets at this apex as well as at an identical apex on the side 42 (not shown). The circumferential fold 140 is located at the distance ½ a from the bottom fold 82. A further circumferential fold 150 is located a further distance ½ a from the fold 140. Both folds 140, 150 extend completely around the sack. The triangular folds 128, 130 and like folds on the side wall 42 allow the bottom to be collapsed, the side walls folded along their longitudinal folds 48, 138, and the bottom folded flat against the top wall 81. The triangular folds 128 and 130 permit the bottom of the bag to collapse upward as the fold 140 collapses on itself similar to a conventional bag. The bottom 20 may then be folded one way or the other about the fold 140 and then folded again about the fold 150 in order to reduce the size of the folded bag. This results in a flat folded sack for storage. As the bag of the invention is unfolded, fold 140 serves a second function. The fold 140 defines connecting panels 160 between the front and rear walls 12 and 14, respectively, and the bottom 20 and further defines connecting panels 162 between the side walls 16 and 18 and the bottom 20. When the bag is in an unexpanded condition, the connecting panels 160 and 162 remain parallel to the front, rear and side walls as shown in FIG. 2. As the bag expands, the connecting panels bend about the fold 140 and the folds 80 and 82 at the bottom 20 permitting the remaining portion of the front, rear and side walls to expand outward so that the bag increases in volume and retains its generally rectangular configuration as is illustrated in FIG. 1. The connecting panels 160 and 162 extend between the bottom 20 and the front, rear and side walls of the bag and assist in defining the height h illustrated in FIG. 1 above which the bag retains its rectangular configuration.

As described above, a multi-gusseted folded bottom bag is formed having a preselected bottom size but with expandable side walls. Thus, an increase in effective bag size and volume car be achieved without changing existing bag forming machinery which is size limited to the existing bottom size.

Additionally, although a sack with two edge gussets per side is shown, any number of gussets can be added to the side walls from one to a plurality more than two. The gussets can be edge located as shown or possibly located inward of the edge at a position located along the depth of the sack. Gussets can be provided on the front and back walls, in leu of or in addition to the side walls. The number of gussets per side wall need not be equal, in fact, one side wall can be provided with a gusset(s) and the other not provided with a gusset. All such combinations are encompassed by the invention.

Although the present invention has been described with reference to a specific embodiment, those of skill in the art will recognize that changes may be made thereto without departing from the scope and spirit of the invention as set forth in the appended claims.

I claim as my invention:

1. A sack comprising:

a planar front wall having a bottom edge and a pair of side edges;

a planar rear wall having a bottom edge and a pair of side edges;

first and second side walls, each having a bottom edge and a pair of side edges a V-shaped gusset connecting each side edge of said first and second side walls to each side edge of said front and rear walls;

a bottom having a width generally equal to a width of said front and rear walls and a depth generally equal to a width of said side walls; and a connecting panel connecting each bottom edge of said front, rear and side walls to said bottom closing said rectangular configuration, said V-shaped gussets and said connecting panels allowing expansion of said sack above said bottom to a depth greater than a depth of said bottom.

2. The sack a cording to claim 1, wherein said bottom comprises rectangular portions folded inwardly from end portions of said first and second side walls, and trapezoidally shaped flaps formed from end portions of said front and rear walls and end portions of said V-shaped gussets, folded over and secured overlying said rectangular portions.

3. The sack a cording to claim 2, wherein said first and second side walls are bisected by a longitudinal fold.

4. The sack according to claim 2, wherein said end portions of said V-shaped gussets are folded flat, and said trapezoidally shaped flaps are formed by folding inward each bottom corner of said front and rear walls along an oblique line along with said folded flat end portions of said V-shaped gussets, said oblique line at a 45° angle to an end of said respective front and rear walls.

5. The sack a cording to claim 1, wherein said bottom is formed by folding inwardly end portions of said first and second side walls and end portions of said front and rear walls, and adhesively securing the end portions of said front and rear walls together to secure said bottom.

6. The sack a cording to claim 5, further comprising a longitudinal central gusset fold and triangular folds on each of said side walls, said triangular folds extending from corners of said bottom to an apex on said central gusset fold of each of said side walls.

7. The sack according to claim 6, further comprising a circumferential fold extending around said side walls, front wall and rear wall in a plane passing through said apex of each side wall defining said connecting panels.

8. The sack according to claim 1, wherein handles are provided adjacent to an open top of said sack at a top edge of said front wall and said rear wall.

* * * * *